United States Patent [19]

Hamrick et al.

[11] Patent Number: 4,753,141

[45] Date of Patent: Jun. 28, 1988

[54] ADJUSTABLE WRENCH

[76] Inventors: James N. Hamrick, 170 Mountain St.; James N. Hamrick, Jr., P.O. Box 948, both of, Rutherfordton, N.C. 28139

[21] Appl. No.: 4,772

[22] Filed: Jan. 9, 1987

Related U.S. Application Data

[63] Continuation of Ser. No. 775,790, Sep. 13, 1985, abandoned.

[51] Int. Cl.[4] ..... B25B 13/16

[52] U.S. Cl. ..... 81/166; 81/167; 81/418; 81/186

[58] Field of Search ..... 81/166, 173, 175, 165, 81/170, 418, 186, 424.5, 129, 129.5, 157–158, 167, 119, 121.1, 124.7

[56] References Cited

U.S. PATENT DOCUMENTS

| | | | |
|---|---|---|---|
| 2,733,626 | 2/1956 | Mesojedec | 81/165 |
| 2,765,690 | 10/1956 | Mayer | 81/165 |
| 3,190,154 | 6/1965 | Chapman | 81/165 |
| 3,916,735 | 11/1975 | Evans | 81/165 |
| 3,926,077 | 12/1975 | Nordgren | 81/165 |

OTHER PUBLICATIONS

Armstrong Bros., Tool Co., Catalog p. 94, "4" Series-½ Inch Square Drive.

*Primary Examiner*—Frederick R. Schmidt
*Assistant Examiner*—Maurina Rachuba
*Attorney, Agent, or Firm*—Dority & Manning

[57] ABSTRACT

An adjustable wrench having a fixed jaw and a spring biased movable jaw. A coil spring acts on an end of a worm gear opposite the fixed jaw, which, in turn, acts on a rack of teeth provided on a portion of the movable jaw to force the movable jaw towards the fixed jaw. The worm gear is rotated to advance the movable jaw against an object which is to be gripped. Upon contact of both the movable jaw and the fixed jaw with the object, the worm gear is rotated further to compress the coil spring. The force of the coil spring against the worm gear diminishes looseness between the worm gear and the movable jaw, and compression of the coil spring further diminishes any such looseness and enhances holding power of the wrench about the object.

4 Claims, 1 Drawing Sheet

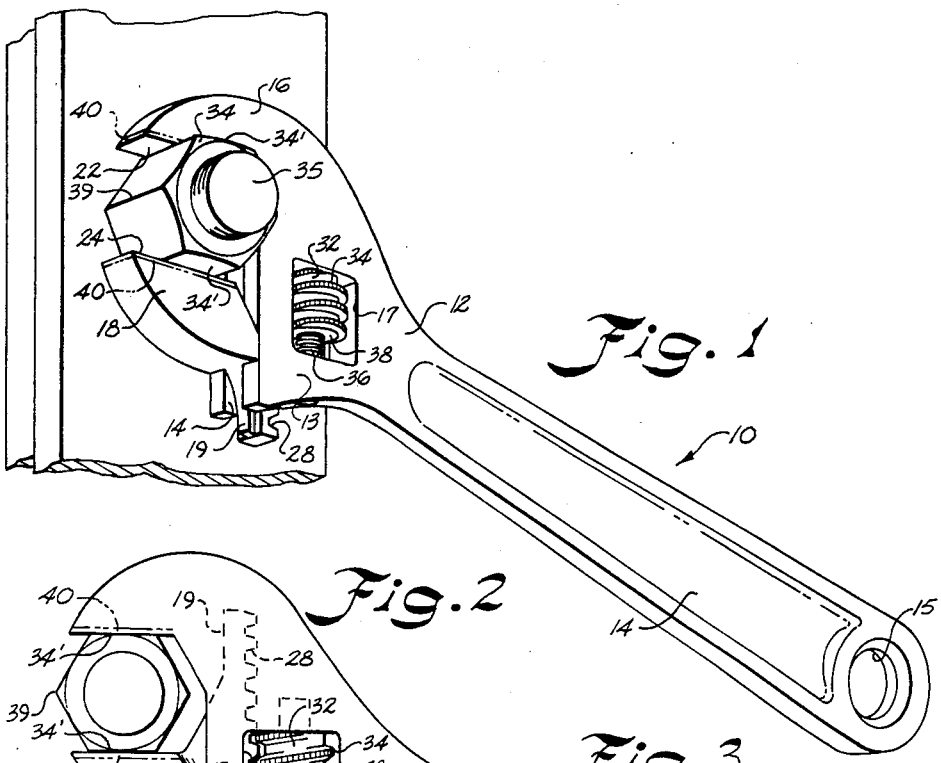
Fig. 1
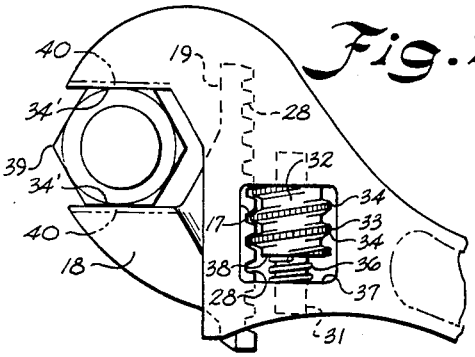
Fig. 2
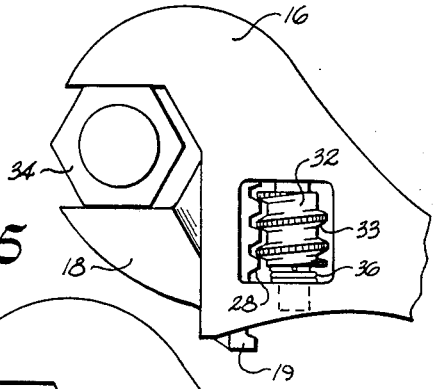
Fig. 3
Fig. 4
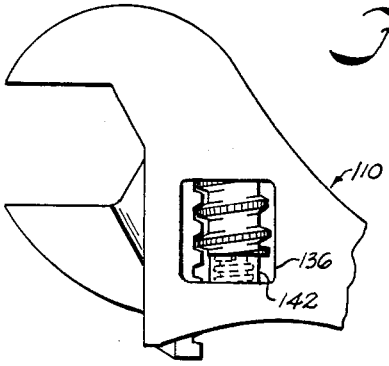
Fig. 5
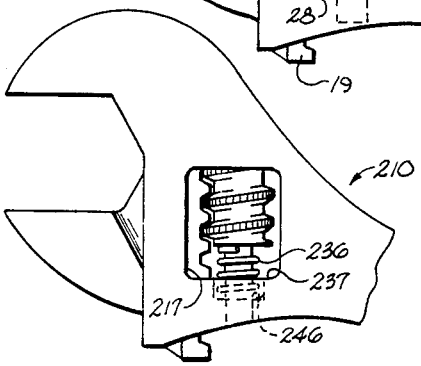

ADJUSTABLE WRENCH

This is a continuation of application Ser. No. 775,790 filed Sept. 13, 1985 which was abandoned upon the filing hereof.

BACKGROUND OF THE INVENTION

In using a typical adjustable wrench, the jaws of the wrench are placed around a nut, bolt or the like which is to be loosened or tightened, and a knurled worm gear on the wrench is rotated until the jaws grip the bolt tightly. Because the item being gripped is not normally compressible, it is difficult to tighten the worm gear enough with the fingers to get the jaws of the wrench tight enough against the item so that play in the wrench is eliminated. The play in the jaws of the wrench is undesirable as it increases the likelihood of the jaws slipping on the corners of a nut, for example, thereby deformably rounding the corners and ruining the nut.

There is an adjustable wrench on the market, which is sold by Sears Roebuck & Co., which uses a spring tensioned worm gear to apply bias against the worm gear of the wrench in a direction away from the fixed jaw of the wrench. The spring biased worm of the Sears wrench reduces the amount of play in the worm gear, but does not substantially reduce the amount of play in the jaws as they are tightened around an item, nor does it ensure improved holding power of the jaws about an item. This is because in tightening the jaws around the item, the user is not working to compress the spring but is working, in effect, to compress the item between the jaws, in the same manner as do adjustable wrenches which do not have spring biased worm gears.

Other prior art wrenches in which a spring bias is found are disclosed in U.S. Pat. Nos. 1,778,748 to Bayrer; 753,862 to Eliel et al.; 957,726 to Armstrong; and 3,983,768 to Smith, and in British Pat. No. 207,901 (1922) to Dorvak. None of such prior art noted hereinbefore teaches or suggests the wrench of the present invention.

SUMMARY OF THE INVENTION

The present invention provides an adjustable wrench which is spring-biased to allow the jaws of the wrench to precisely fit without movement relative to whatever is engaged by the wrench. The invention provides an adjustable wrench in which a movable jaw is opened or closed by the rotation of a worm gear by the thumb and fingers. The worm gear acts in concert with transverse teeth carried along the bottom edge of the movable jaw. Upon rotation of the worm gear, the movable jaw moves within a groove towards or away from a fixed jaw, depending on the direction in which the worm gear is rotated. The worm gear is rotably carried in a slot portion located adjacent the bottom of the jaws. A spring is carried coaxially with the worm gear and is interposed between the worm gear and a side of the slot opposite the fixed jaw of the wrench. The spring biases the worm gear, and thus the movable jaw which rides on the worm gear, towards the fixed jaw of the wrench.

The worm gear is rotated to advance the movable jaw against an object to be gripped. Once the movable jaw is in contact with the object, further turning of the worm gear causes the spring to compress, and when fully compressed, greatly enhanced holding power is provided, not to mention retained jaw location. The spring thus allows the movable jaw to be tightened against the object in a sufficient amount so that virtually all of the play or looseness normally associated with the gripping of an adjustable wrench on an object is eliminated. Also, if the wrench is removed from the object, the spring continues to apply force against the movable jaw through the worm gear and maintains the movable jaw against lateral displacement in an outward direction. The wrench may then be replaced about the object without any need for readjustment as is normally required of conventional wrenches. Bevels on outer edges of the wrench jaws facilitate such replacement.

Accordingly, an object of the present invention is to provide an adjustable wrench which virtually eliminates play, or relative movement, between the jaws of the wrench and an object which is gripped by the jaws.

Another object of the present invention is to provide an adjustable wrench which, once adjusted to grip an object, may be removed from the object and reapplied to the object without having to be readjusted.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an of the invention is shown and wherein:

FIG. 1 is a perspective view of an adjustable wrench constructed in accordance with teachings of a preferred embodiment of the present invention.

FIGS. 2 and 3 are partial side elevational views of an adjustable wrench as illustrated in FIG. 1.

FIG. 4 is a partial side elevational view of an alternate embodiment of an adjustable wrench constructed in accordance with teachings of the present invention.

FIG. 5 is a partial side elevational view of an alternate embodiment of an adjustable wrench constructed in accordance with teachings of the present invention.

DESCRIPTION OF A PREFERRED EMBODIMENT

Referring now to the Figures, the present invention will be described in detail. An adjustable wrench generally 10 is depicted in FIG. 11 having an elongated body 12 which forms in part, a handle portion 14, and with fixed jaw 16 integral with elongated body 12 at an end opposite handle 14.

Body 12 of wrench 10 further has an end portion 13 located against the base of fixed jaw 16 and extending laterally therefrom. End portion 13 is provided with a groove 14 therealong for association with a movable jaw 18. Body 12 of wrench 10 further defines a slot 17 adjacent groove 14 for receipt of a jaw adjustment member 32 therewithin. Each jaw 16, 18 has an inwardly facing gripping surface 22, 24, respectively. A hole 15 is provided in elongated body 12 for hanging of wrench 10 when not in use.

Movable jaw 18 has an elongated base 19 at a lower end of same which is received within groove 14, and which has a plurality of transverse teeth 28 therealong. Jaw adjustment member 32 is rotatably received about a partially threaded element 31 secured within body 12 at opposite sides of slot 17 (see FIG. 2) and has a raised helical head 33, the outer surface 34 of which is knurled for ease of finger manipulation. Adjustment member 32 is preferably a type of worm gear and is sometimes hereinafter referred to, without limitation, as such. Helical head 33 of adjustment member 32 interengages with transverse teeth 28 at a plurality of turns, wherefore rotation of adjustment member 32 will impart movement to jaw 18 in a direction toward and away from fixed jaw 16 dependent upon the direction of rotation of same.

Wrench 10 is shown gripping a nut 34 which is threadably received about a bolt 35 in FIG. 1. Movable jaw 18 is advanced against the nut 34 by rotation of the worm gear 32 so that the gripping surfaces 22, 24 of the jaws 16, 18 tightly contact the flat faces 34' of the nut 34. A compressible pressure means 36, illustrated as a coil spring is interposed between and contacts an edge 37 of the slot 33 and an end face 38 of the worm gear 32. Once the movable jaw 18 is brought into contact with flat faces 34' of nut 34, further rotation of the worm gear 32 in its tightening direction causes the coil spring 36, which is carried coaxially with the worm gear 32 to compress. Compression of the coil spring 36 allows for the worm gear 32 to be further tightened after movable jaw 18 contacts nut 34. Any looseness between worm gear 32 and transverse teeth 28 can thus be virtually eliminated by coil spring 36, which presses worm gear 32 tightly against transverse teeth 28. Such tight contact between worm gear 32 and transverse teeth 28 allows for movable jaw 18 to be snugly held against nut 34 in a manner that eliminates virtually all of the play, or relative movement, between the jaws 16, 18 and nut 34. By eliminating the play between the jaws 16, 18 and the nut 34, the likelihood of the corners 39 of the nut 34 becoming deformed, or rounded, due to relative movement between the jaws 16, 18 and nut 34 is greatly reduced. For best results as to both elimination of play and improved wrench holding power, coil spring 36 is fully compressed.

In FIG. 2, the movable jaw 18 is shown as it initially contacts nut 34. Coil spring 36 has not yet begun to become compressed. In FIG. 3, movable jaw 18 is shown tightly contacting the nut 34 after worm gear 32 has been rotated further by an amount to sufficiently fully compress coil spring 36, thereby virtually eliminating any play between the jaws 16, 18 and nut 34.

Should wrench 10 be removed from an object such as a nut 34 after being tightly adjusted for same, as illustrated in FIG. 3, jaw 18 will be restrained from lateral movement within groove 14 away from the fixed jaw 16 by the coil spring 36 so that wrench 10 may later be reapplied to nut 34 without further adjustment. Bevels 40 are provided along outer edges of gripping surfaces 22, 24 to aid in the placement of wrench 10 about nut 34 after wrench 10 has been adjusted and once removed from the nut 34.

In FIG. 4, an alternate embodiment of a wrench 110 according to the present invention is illustrated. Coil spring 136 is located within a cylindrical sleeve 142. The height of cylindrical sleeve 142 is approximately equal to the height of coil spring 136 when the coil spring 136 is fully compressed. Cylindrical sleeve 142 thus partially shields coil spring 136 from exposure to dirt and the like. Otherwise, the elements are as stated with respect to the embodiment illustrated in FIGS. 1 through 3.

FIG. 5 illustrates a further alternate embodiment of a wrench 210 according to the present invention wherein a recess 246 is provided in an edge 237 of slot 217. The depth of recess 246 is approximately equal to the height of the coil spring 236 when it is compressed. Recess 246 thus also partially shields coil spring 236 from exposure to dirt and the like. Otherwise, the elements of wrench 210 are as stated with respect to the embodiment illustrated in FIGS. 1 through 3.

Other types of compressible pressure means may be used instead of a coil spring to bias the movable jaw 18 towards the fixed jaw 16. Also, the threaded rotatable adjustment member of a pipe wrench could be spring biased in the same manner as is the adjustable wrench 10 illustrated in the figures, to reduce play in the jaws of the pipe wrench as it grips an object.

It will also be understood, of course, that while the form of the invention herein shown and described constitutes a preferred embodiment of the invention, it is not intended to illustrate all possible forms of the invention. It will also be understood that the words used are words of description rather than of limitation, and that various changes may be made without departing from the spirit and scope of the invention herein disclosed.

What is claimed is:

1. An improved adjustable wrench comprising an elongated generally rigid body; said body including a fixed jaw at one end of same with said fixed jaw having a gripping surface, said body defining a groove located adjacent a base of said fixed jaw and extending transversely therefrom, said body further defining a slot therethrough adjacent and beneath a portion of the length of said groove; a moveable jaw having a gripping surface that is generally mateable with the gripping surface of said fixed jaw when said jaws are closed, said fixed and moveable jaws having beveled outer edges about the gripping surfaces of same, said moveable jaw including a base portion received in said groove for movement therealong, said base portion having a plurality of teeth thereon extending generally transverse to the length of said groove; a worm gear received for rotation and axial movement in said slot and having portions thereof mateably engaged with said transverse teeth of said moveable jaw; and spring means, received between said body and an end of said worm gear opposite said fixed jaw, for biasing said worm gear into contact with said transverse teeth to diminish loose play therbetween, and for being further compressible after said moveable jaw makes contact with an object to be gripped so that said worm gear is moved axially away from a side of said slot nearest said fixed jaw so that such object is gripped sufficiently tight with an established distance between said jaws and by spring-biasing during gripping for applying torque to the object in either rotatable direction with said wrench without racheting; whereby, when said wrench is adjusted for an object to be gripped and is removed therefrom, said spring means pushes said worm gear into contact with said slot side, which pushing closes said jaws closer than said established distance, while said beveled portions of said jaws will permit said jaws to be reopened to said established distance for said wrench to be reapplied to such object without further adjustment.

2. A wrench as defined in claim 1 wherein said worm gear is mounted within said slot about a portion of a threaded element and said coil spring is received about a portion of same, coaxial with said worm gear.

3. A wrench as defined in claim 1 wherein said coil spring is received in part within a tubular element, said element having a length approximately the length of said coil spring when fully compressed.

4. A wrench as defined in claim 1, wherein said body further defines:

a recess coaxial with said spring means and said pressure means comprises a coil spring, one end of which is received in said recess; and wherein said recess has a depth dimension approximately equal to the length of said coil spring when said coil spring is fully compressed.

* * * * *